US010555373B2

(12) United States Patent
Nakayama et al.

(10) Patent No.: US 10,555,373 B2
(45) Date of Patent: Feb. 4, 2020

(54) HEATER CONTROL DEVICE AND IMAGE FORMING APPARATUS

(71) Applicant: Ricoh Company, Ltd., Tokyo (JP)

(72) Inventors: Shuntaro Nakayama, Yamato (JP); Keita Maejima, Sagamihara (JP); Ryota Kubokawa, Zama (JP)

(73) Assignee: RICOH COMPANY, LTD., Tokyo (JP)

( * ) Notice: Subject to any disclaimer, the term of this patent is extended or adjusted under 35 U.S.C. 154(b) by 1167 days.

(21) Appl. No.: 14/821,272

(22) Filed: Aug. 7, 2015

(65) Prior Publication Data

US 2016/0044745 A1 Feb. 11, 2016

(30) Foreign Application Priority Data

Aug. 7, 2014 (JP) ..... 2014-161533
Apr. 21, 2015 (JP) ..... 2015-086624

(51) Int. Cl.
*H05B 1/02* (2006.01)
*G03G 15/20* (2006.01)

(52) U.S. Cl.
CPC ..... *H05B 1/0241* (2013.01); *G03G 15/2039* (2013.01)

(58) Field of Classification Search
CPC ..... G03G 15/2039; H05B 1/0241; H05B 1/0288; H05B 3/0066; H05B 1/02
USPC ..... 219/216, 481, 483, 486, 497, 505; 355/30, 69, 405
See application file for complete search history.

(56) References Cited

U.S. PATENT DOCUMENTS

2011/0064444 A1 3/2011 Adachi et al.
2012/0051775 A1 3/2012 Miyata et al.
2014/0270835 A1 9/2014 Umezawa et al.

FOREIGN PATENT DOCUMENTS

JP 4-168468 A 6/1992
JP 11-24487 A 1/1999
JP 2004-191710 A 7/2004
JP 2011-64824 A 3/2011
JP 2011-85915 A 4/2011
JP 2012-37804 A 2/2012

OTHER PUBLICATIONS

Office Action dated Jan. 29, 2019 in corresponding Japanese Patent Application No. 2015-086624, 2 pages.

*Primary Examiner* — Mark H Paschall
(74) *Attorney, Agent, or Firm* — Xsensus LLP

(57) ABSTRACT

A heater controller and heater control method is disclosed. The hater controller includes a detector, a determination circuit, a limiting circuit, a selection circuit, and a driving circuit. The detector detects a temperature of the heating object, which is heated by the heater. The determination circuit determines turn-on ratio for the heater for every control cycle of AC voltage, based on the surface temperature of the heating object and a target temperature of the heating object. The limiting circuit limits the turn-on ratio of current control cycle when the control method of previous control cycle is phase control. The selection circuit selects control pattern to control the heater, based on the turn-on ratio, and the driving circuit applies a heater driving signal to the heater.

14 Claims, 13 Drawing Sheets

HEATER CONTROL DEVICE AND IMAGE FORMING APPARATUS

CROSS-REFERENCE TO RELATED APPLICATIONS

The present application claims priority to and incorporates by reference the entire contents of Japanese Patent Application No. 2014-161533, filed in Japan on Aug. 7, 2014, and Japanese Patent Application No. 2015-086624, filed in Japan on Apr. 21, 2015, the contents of which are incorporated by reference in their entirety.

BACKGROUND

1. Field

This application relates to a heater control device and method for controlling turn-on of a heater, as well as an image forming apparatus.

2. Description of the Related Art

A halogen heater is used as a fixing heater used for an electro-photographic image forming apparatus. The halogen heater has a characteristic that inrush current easily occurs. Therefore, a voltage drop occurs at a commercial power supply in synchronization with a turn-on timing of the heater, which causes a lighting device such as a fluorescent light to flicker. There is known, therefore, a phase control technology for suppressing inrush current to the heater.

Further, there is known a turn-on/off pattern control technology for controlling a turn-on (energize) pattern of the heater. The human eye is most sensitive to light fluctuations in the frequency range near 10 Hz having and its center at 8.8 Hz. With recent image forming apparatuses, the heater-on/off pattern is set so as to avoid the frequency range where the human eye is sensitive to flicker or such that frequency band is shifted to reduce flicker to a minimum.

When the phase control technology and the turn-on/off pattern control are combined for controlling the heater, it should be considered that it cannot improve frequency characteristics effectively with certain duty cycle during transition period from the phase control to turn-on/off pattern control. Moreover, it should be considered that it cannot reduce flicker effectively.

SUMMARY

Embodiments of the present disclosure relate to a heater controller and heater control method. For example, an embodiment of a heater controller in accordance with the present disclosure includes a detector, a determination circuit, a limiting circuit, a selection circuit, and a driving circuit. The detector detects a temperature of a heating object, the heating object is heated by the heater. The determination circuit determines, based on a surface temperature of the heating object and a target temperature of the heating object, a turn-on ratio of the heater for every control cycle of an AC voltage. The limiting circuit limits the turn-on ratio of a current control cycle when a control method of a previous control cycle is phase control. The selection circuit selects a control pattern to control the heater, based on the turn-on ratio limited by the limiting circuit, and the driving circuit outputs a heater driving signal to the heater according to the control pattern selected by the selection circuit.

DETAILED DESCRIPTION OF THE PREFERRED EMBODIMENTS

Hereinafter, embodiments of a heater control device and a heater control method according to the present invention are explained in detail below with reference to the accompanying drawings.

Figure 1:
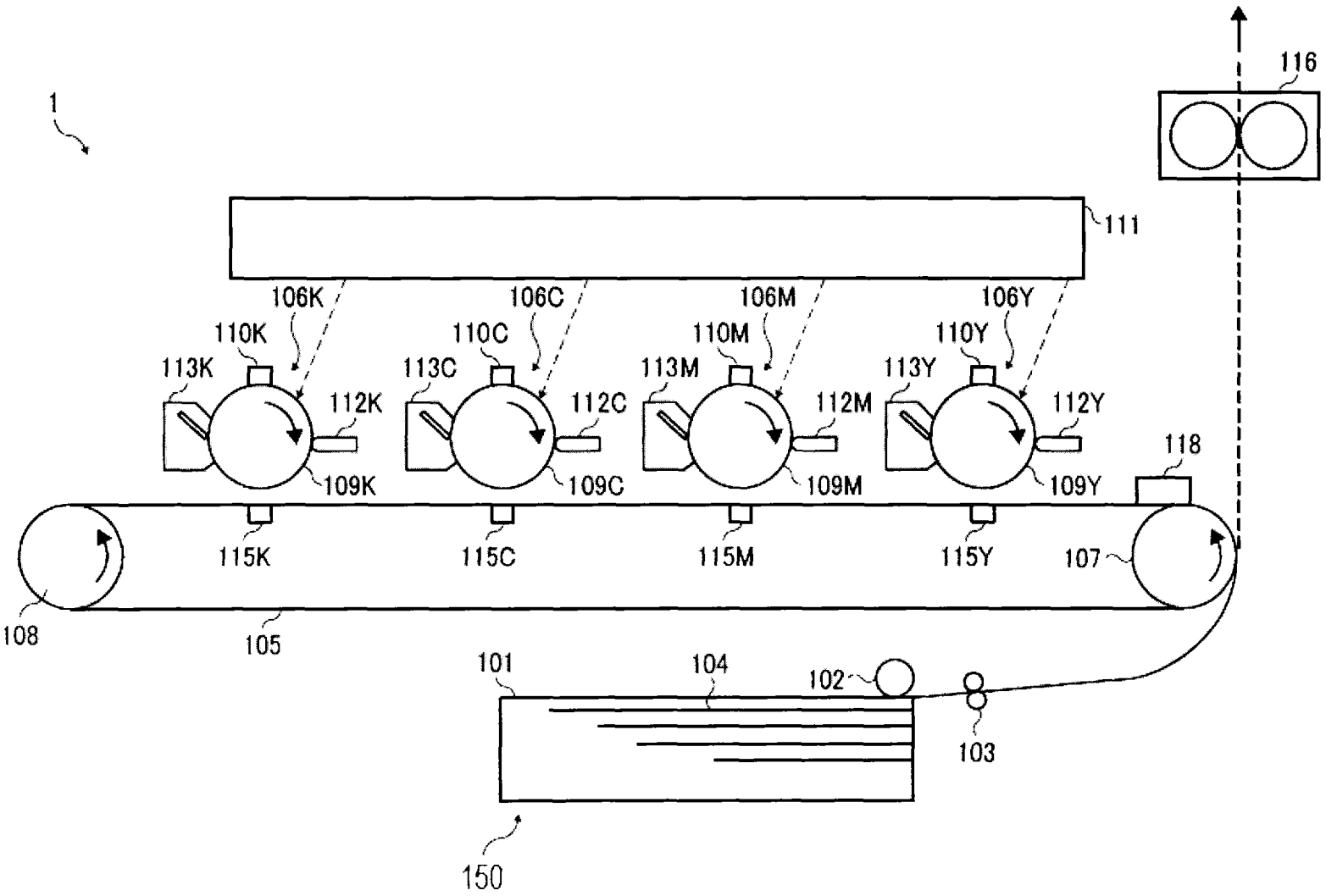
FIG. 1 illustrates a diagram illustrating a configuration of an exemplary print engine.

FIG. 1 illustrates a diagram of a configuration of a print engine according to the present disclosure. The print engine is implemented in an image forming apparatus.

As illustrated in FIG. 1, print engine 1 includes a plurality of image forming units 106 that are arranged along a carriage belt 105. Such configuration, namely a plurality of image forming units, is arranged along the carriage belt, referred to as a tandem type. In the tandem type configuration, a plurality of image forming units 106Y, 106M, 106C, and 106K (hereinafter collectively referred to as the image forming unit 106) is arranged along the carriage belt 105. For example, the image forming unit 106 may employ an electro photograph processing process.

The plurality of image forming units 106Y, 106M, 106C, and 106K is different only in the color of a toner image to be formed and has a common internal configuration. The image forming unit 106K, the image forming unit 106M, the image forming unit 106C, and the image forming unit 106Y form a black image, a magenta image, a cyan image, and an yellow image, respectively. In the following description, the image forming unit 106Y is specifically described, but the other image forming units 106M, 106C, and 106K are similar to the image forming unit 106Y. Therefore, the reference numerals of the components of the image forming units 106M, 106C, and 106K are distinguished by M, C, and K and just displayed in the drawing instead of Y assigned to the components of the image forming unit 106Y, and their individual descriptions will be omitted.

The carriage belt 105 is an endless belt, in other words, an endless-shaped belt—that is hung between a drive roller 107 to be rotated and driven and a driven roller 108. The drive roller 107 is rotated and driven by a drive motor (not shown). The drive motor, the drive roller 107, and the driven roller 108 function as a drive unit for moving the carriage belt 105 being the endless moving unit.

The sheet 104 is fed from the paper feed tray 150. Typically, the paper feed tray 150 has a plurality of paper trays 101. In FIG. 1, however, only one paper tray 101 is illustrated. The sheet 104 fed from the paper tray 101 stops once at a registration roller 103, and is sent out to a transfer position of an image from the carriage belt 105 at the timing of image formation at the image forming unit 106.

In the image forming process, the first image forming unit 106Y transfers a yellow toner image onto the carriage belt 105. The image forming unit 106Y includes a photosensitive drum 109Y as a photosensitive element, charger 110Y, a developing device 112Y, a photosensitive element cleaner (not shown), a neutralization device 113Y are respectively arranged on the circumference of the photosensitive drum 109Y. An optical writing device 111 is configured so as to radiate light onto each of photosensitive drums 109Y, 109M, 109C, and 109K (hereinafter collectively referred to as the "photosensitive drum 109"). A detailed configuration of the optical writing device 111 will be provided later.

The outer surface of the photosensitive drum 109Y is evenly charged by the charger 110Y when not exposed. Then, writing is performed by light from a light source of the optical writing device 111 to form an electrostatic latent image on the surface of the photosensitive drum 109Y The light source for the photosensitive drum 109Y corresponds to a yellow image. The developing device 112Y develops the electrostatic latent image with the yellow toner and accordingly a yellow toner image is formed on the photosensitive drum 109Y.

The yellow toner image is transferred onto the carriage belt 105 by the operation of a transfer device 115Y at a position (transfer position) where the photosensitive drum 109Y and the carriage belt 105 are in contact with each other or are closest to each other. With the transfer, an image with the yellow toner is formed on the carriage belt 105.

After the transfer has finished, unnecessary toner remaining on the surface of the photosensitive drum 109Y is removed by the photosensitive element cleaner (not shown) from the photosensitive drum 109Y Then the photosensitive drum 109Y is neutralized by the neutralization device 113Y and waits for the next image formation.

As described above, the yellow toner image transferred by the image forming unit 106Y onto the carriage belt 105 is conveyed to the next image forming unit 106M by the drive of a roller of the carriage belt 105. In the image forming unit 106M, a magenta toner image is formed on the photosensitive drum 109M by a similar process to the image formation process at the image forming unit 106Y. Then, the magenta toner image is superimposed on the yellow toner image already formed.

The yellow and magenta toner image on the carriage belt 105 is conveyed to the further next image forming units 106C and 106K. A cyan toner image formed on the photosensitive drum 109C and a black toner image formed on the photosensitive drum 109K are, by a similar operation, superimposed onto the yellow and magenta toner image already transferred. In this manner, a full color intermediate transfer image is formed on the carriage belt 105. As explained above, in this embodiment, the carriage belt 105 is an intermediate transfer belt.

The sheets 104 (an example of a recording medium) are stacked in the paper tray 101. The sheets 104 are picked up sequentially from the top, by being separated by a paper feed roller 102. Then, the sheets 104 are fed to the registration roller 103. At the registration roller 103, paper conveyance timing is adjusted to transfer the intermediate transfer image onto the proper position of the sheets 104. Then, the sheets 104 are fed to the transfer position where the conveying path of the sheet is in contact with the carriage belt 105. At the transfer position, the intermediate transfer image on the carriage belt 105 is transferred onto the sheets 104. As a result, an image is formed on the sheet 104. The sheet 104 where the image has been formed thereon is further conveyed, and the image is fixed by a fixing device 116. The sheets 104 are conveyed to a paper discharge tray (not shown).

A belt cleaner 118 is provided to remove any toner remaining on the carriage belt 105. The belt cleaner 118 may be a cleaning blade pressed against the carriage belt 105 on the downstream side of the drive roller 107 and on the upstream side of the photosensitive drum 109 as illustrated in FIG. 1. The belt cleaner 118 is a developer removing unit for scraping off the toner attached to the surface of the carriage belt 105.

A heater is disposed inside the fixing device 116. The heater adds heat to the fixing roller at the fixing device 116 and thus the toner on the sheets 104 is melted and fixed.

Figure 2:
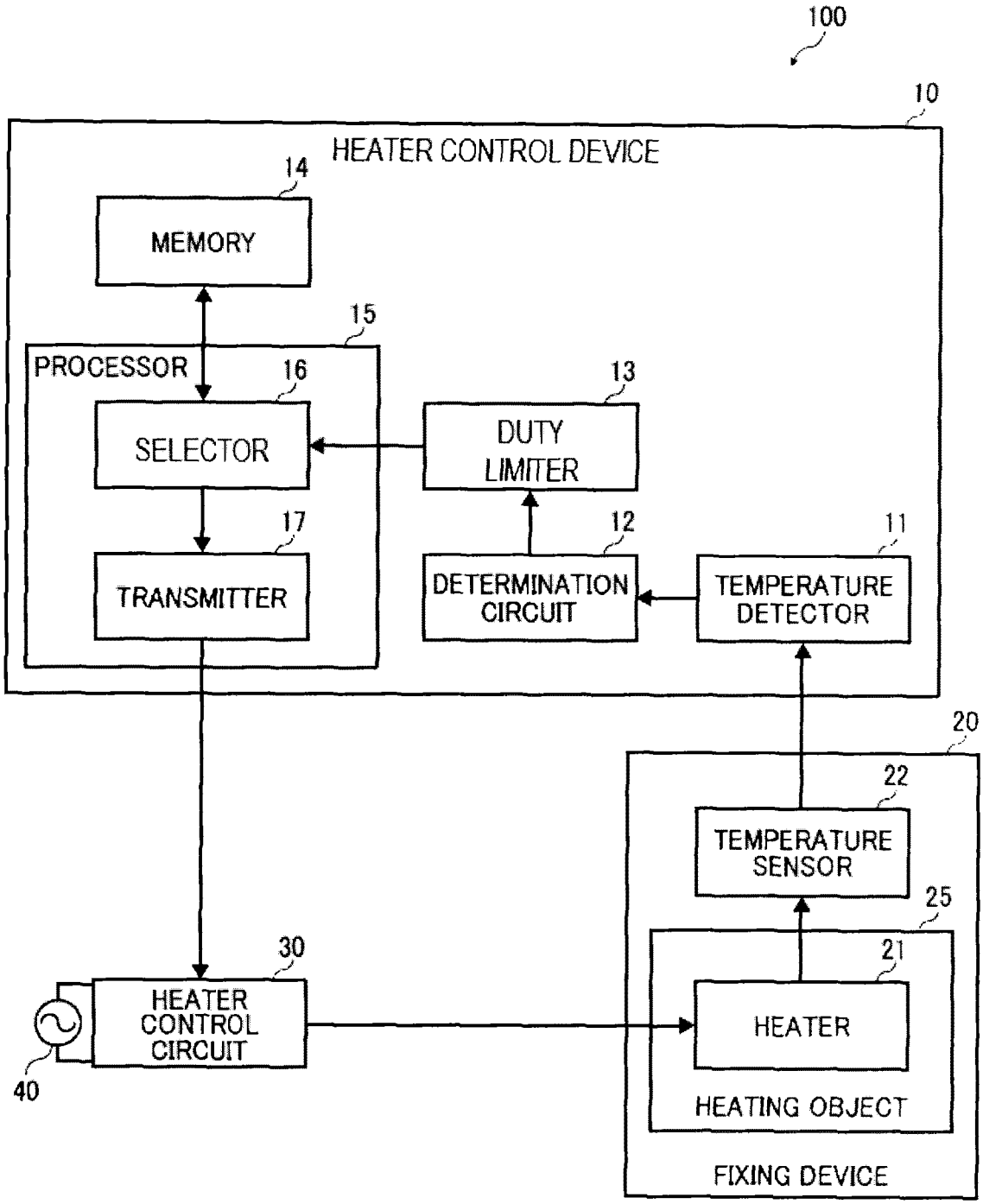
FIG. 2 illustrates a block diagram of a heater controller of the print engine of FIG. 1.

Next, a configuration to control the heater will be illustrated. FIG. 2 is a block diagram illustrating the heater controller 100. The image forming apparatus includes the heater controller 100.

The heater controller 100 includes a heater control device 10, a fixing device 20, and a heater control circuit 30. To the heater control circuit 30, a commercial power supply 40 is connected. The fixing device 20 corresponds to the fixing device 116 in FIG. 1.

The heater control device 10 includes a temperature detector 11, a determination circuit 12, a duty limiter 13, a memory 14 and a processor 15. The fixing device 20 includes a heater 21, a temperature sensor 22, and a heating object 25. The heater 21 in the fixing device is, for example a halogen heater, and it heats a heating object 25. In this embodiment, the heating object 25 may be a fixing roller in the fixing device 20 (explained later). The temperature sensor 22 is situated in close proximity to the heating object 25, and detects the surface temperature of a heating object 25. As the temperature sensor 22, a thermistor or a thermopile may be used.

An output of the temperature sensor 22 is applied to the temperature detector 11. The temperature detector 11 detects the surface temperature of the heating object, by receiving the output value of the temperature sensor 22. The detected surface temperature of the heating object is applied to the determination circuit 12. The determination circuit 12 determines a turn-on ratio (turn-on duty ratio) for the heater 21 for every control cycle of AC voltage, based on the surface temperature of the heating object and a target temperature of the heating object for every control cycle of AC voltage, based on the surface temperature of the heating object and a target temperature of the heating object 25.

First, the determination circuit 12 receives the detected surface temperature of the heating object 25 from the temperature detector 11. Next, the determination circuit 12 determines the turn-on ratio of the heater 21 for every control cycle of AC voltage, in accordance t the duty limiter 13.

The duty limiter 13 first determines whether the turn on ratio of previous control cycle is 0%. In other words, the duty limiter 13 determines whether the heater 21 was turned on or off during the previous control cycle or not. When the turn on ratio of previous control cycle is 0%, the duty limiter 13 generates a command to start turn on of the heater 21 with the phase control method. This command is applied to the processor 15.

When the turn on ratio of previous control cycle is not 0%, the duty limiter 13 then determines whether the control method of the previous control cycle is the phase control method or not. When the control method of the previous control cycle is the phase control method, the duty limiter 13 limits the turn-on ratio.

First, the duty limiter 13 receives the determined turn-on ratio from the determination circuit 12. Next, the duty limiter 13 determines whether the turn-on ratio is more or less than 50%. When the turn-on ratio is more than 50%, the duty limiter 13 limits the turn-on ratio to 50%. On the contrary, when the duty ratio is lower than 50%, the duty limiter 13 does not limit the turn-on ratio. In other words, when the turn-on ratio is lower than 50%, the current turn-on ratio is maintained. Then, the limited (or maintained) turn-on ratio is applied to the processor 15. Where, in this embodiment, the turn-on ratio stated above should not be limited to 50%, but the other ratio may be used.

The memory 14 stores a plurality of turn-on control patterns associated with turn-on ratios. In addition, the memory 14 stores a plurality of phase control patterns associated with turn-off periods of the heater 21. Here the turn-on control pattern is designed as half-wave control pattern. The half-wave control pattern is a conducting pattern to which one of the full turn-on, full turn-off, or partial turn-on is allocated. On the other hand, the phase control pattern is a conducting pattern used in the control cycle when the phase control method is adopted. The detailed explanation of the turn-on pattern and the phase control pattern will be described later.

The processor 15 includes a selector 16 and a transmitter 17. The processor 15 controls turn-on and off of the heater 21 by using the selected half-wave control pattern among the plurality of half-wave control patterns, based on the turn-on ratio.

First, the processor 15 receives the limited (or maintained) turn-on ratio from the duty limiter 13. Next, the selector 16 selects appropriate half-wave control pattern among the plurality of half-wave control patterns stored in the memory 14. The selected half-wave control pattern is applied to the transmitter 17. The transmitter 17 generates a driving signal to drive turn-on and turn-off of the heater 21, and applies the driving signal to the heater control circuit 30.

Hereinafter, half-wave control after the phase control will be explained in detail. More specifically, when the phase control was performed in a control cycle, half-wave control performed in the next control cycle, will be explained.

FIG. 3A through FIG. 3E illustrates exemplary half-wave control patterns that vary according to a turn-on ratio. These patterns are used for the control cycle with half-wave control after the control cycle during which the phase control was performed. In an exemplary embodiment, the control cycle may set to 10 half-wavelengths, however, the control cycle is not limited to only 10 half-wavelengths. For example, the control cycle may be another set of half-wavelengths, such as 20 half-wavelengths.

Figure 3A:
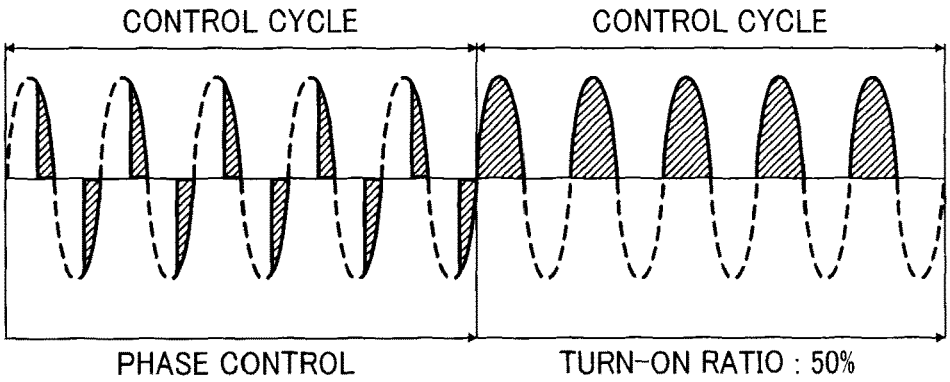
FIG. 3A illustrates an example of half-wave control patterns with turn-on ratios of 50%.
Figure 3B:
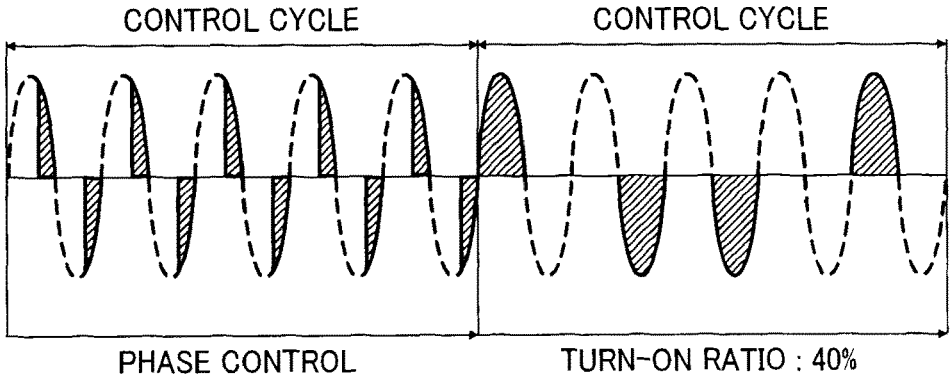
FIG. 3B illustrates an example of half-wave control patterns with turn-on ratios of 40%.
Figure 3C:
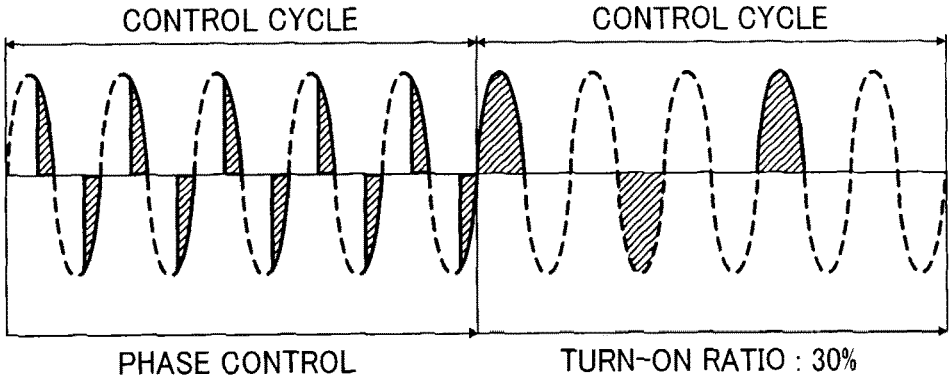
FIG. 3C illustrates an example of half-wave control patterns with turn-on ratios of 30%.
Figure 3D:
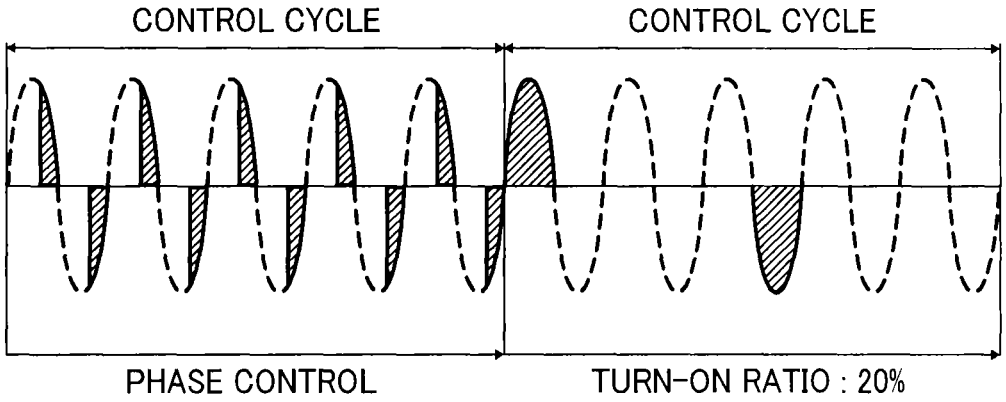
FIG. 3D illustrates an example of half-wave control patterns with turn-on ratios of 20%.
Figure 3E:
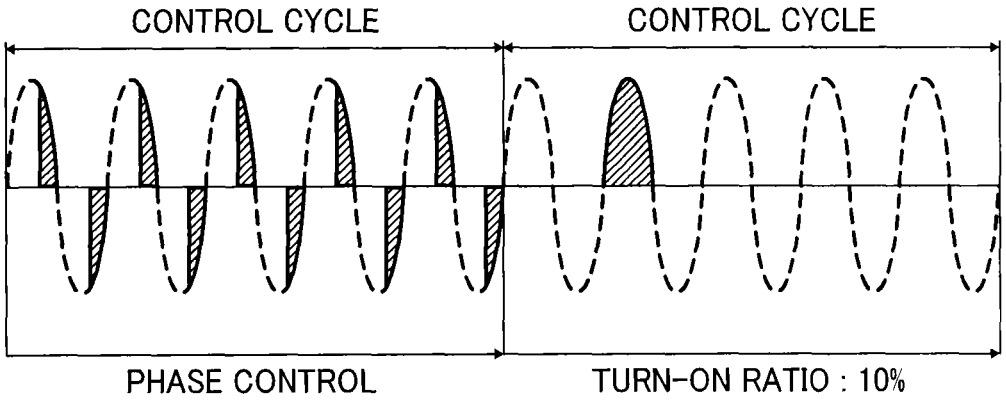
FIG. 3E illustrates an example of half-wave control patterns with turn-on ratios of 10%.

In these figures, the turn-on ratio can be understand the number of turn-on patterns among the 10 half-wavelengths. For example, in FIG. 3A, the first, third, fifth, seventh and ninth half-wavelengths among the 10 half-wavelengths are turned-on. This means that the turn-on ratio is 50% in FIG. 3A. In FIG. 3B, there are four (the first, fourth, sixth, ninth) half-wavelengths among the 10 half-wavelengths are turned-on. This means that the turn-on ratio is 40%. Similarly, the turn-on ratio of FIGS. 3C, 3D, and 3E are 30%, 20% and 10%, respectively.

It will be understood from FIG. 3A through FIG. 3E, that the turn-on is not allocated to two consecutive half-waves during the half-wave control cycle. This is, when the heater 21 was turned off during the previous control cycle or when the phase control was performed during the previous control cycle, turn-on pattern in which more than two consecutive half-waves are turned on has frequency characteristics where the human eye is sensitive to flicker. Because of the aforementioned reason, the turn-on ratio is limited to 50% during the consequent control cycle of the control cycle during which the phase control was performed by the duty limiter 13. In other words, when the phase control is performed, the turn-on patterns with turn-on ratio of up to 50% are selected during the consequent control cycle.

Moreover, in FIG. 3A through FIG. 3E, the full turn-off pattern is allocated to the last half-wave of the every half-wave control cycle. This is to avoid consecutive half-waves are allocated the full turn-on patterns. Such situation will be explained using FIG. 4A and FIG. 4B.

Figure 4A:
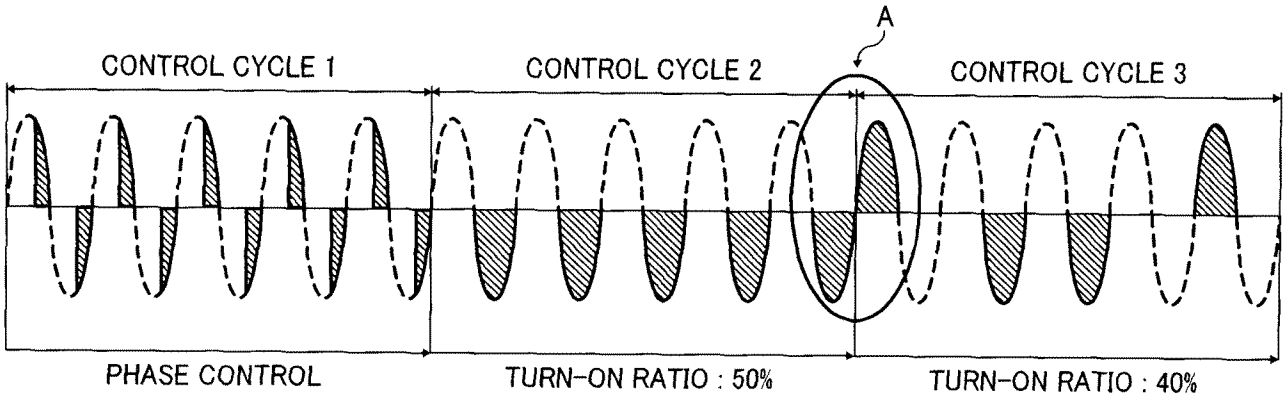
FIG. 4A illustrates an allocation of turn-on during a control cycle.
Figure 4B:
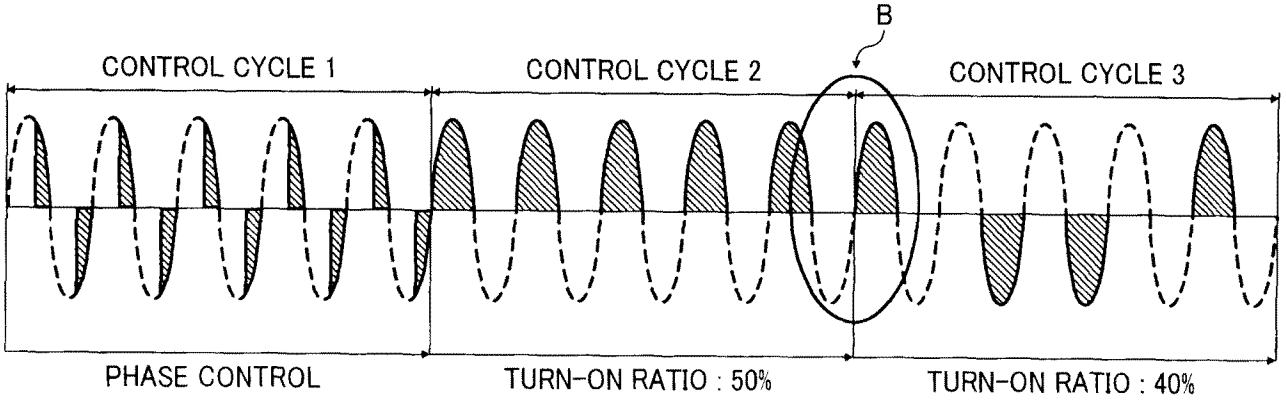
FIG. 4B illustrates another allocation of turn-on during a control cycle.

FIG. 4A and FIG. 4B illustrate three consecutive control cycles. Among the three control cycles, the phase control is performed during the first control cycle, and the half-wave control is performed during the second and the third control cycles.

In FIG. 4A, the full turn-on pattern is allocated to the last half-wave of the control cycle 2. Moreover, the full turn-on pattern is also allocated to the first half-wave of the control cycle 3. As a result, two consecutive half-waves are allocated the full turn-on pattern as indicated by reference A. As illustrated in FIG. 4A, although there are no consecutive half-waves turned on in the same control cycle, there occurs consecutive turn-on at the transition period. Such consecutive turn-on makes the flicker worse.

In FIG. 4B, the full turn-off pattern is allocated to the last half-wave of the control cycle 2, and the full turn-on pattern is also allocated to the first half-wave of the control cycle 3. As illustrated in FIG. 4B, there are no consecutive turn-on patterns neither in the same control cycle nor at the transition period, as indicated by reference B. Accordingly, the processor 15 of this embodiment always turns-off the last half-wave in the half-wave of the control cycle.

Referring back to FIG. 2, phase control to turn-on/turn-off of the heater 21 will be explained in detail. The processor 15 controls to turn-on/turn-off of the heater 21 by selecting appropriate phase control pattern among a plurality of phase control patterns based on the turn-off period of the heater 21. Since a resistant value of the heater 21 varies based on the turn-off time of the heater 21, the processor 15 performs phase control with the consideration to the resistant value.

First, the selector 16 selects appropriate phase control pattern among the plurality of phase control patterns stored in the memory 14 based on the turn-off period of the heater 21. The selected phase control pattern is applied to the transmitter 17. The transmitter 17 generates a driving signal to drive turn-on and turn-off of the heater 21, and applies the driving signal to the heater control circuit 30.

Figure 5A:
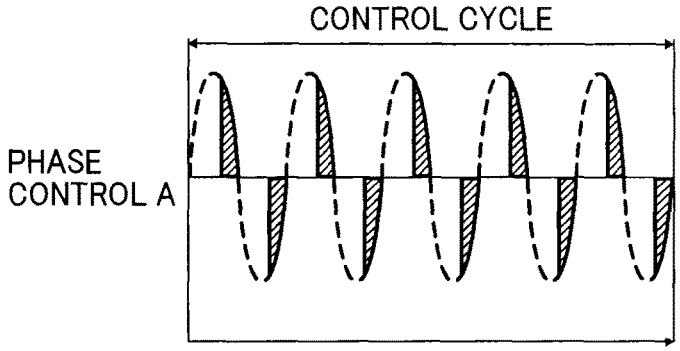
FIG. 5A illustrates a first example of a phase control pattern.
Figure 5B:
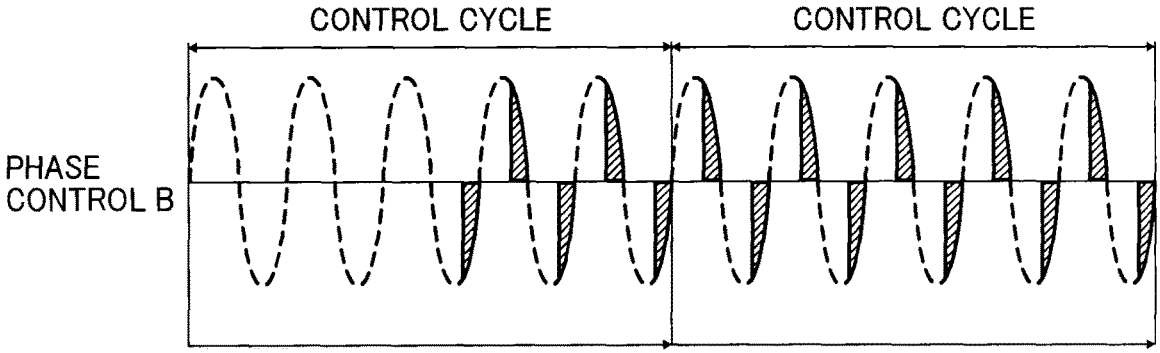
FIG. 5B illustrates a second example of a phase control pattern.
Figure 5C:
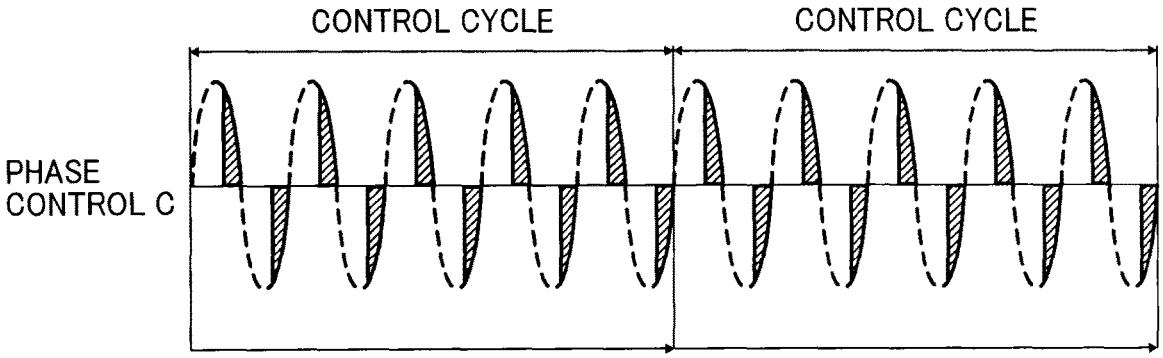
FIG. 5C illustrates a third example of a phase control pattern.

FIGS. 5A-5C illustrate examples of the phase control patterns. FIG. 5A shows a phase control pattern A, FIG. 5B shows a phase control pattern B, and FIG. 5C shows a phase control pattern C, respectively, The phase control pattern A uses one control cycle. Namely, 10 half-wavelengths are included in the phase control pattern A. On the contrary, the phase control pattern B and the phase control pattern C use two control cycles. Namely, 20 half-wavelengths are included in the phase control pattern A. and the phase control pattern C. As understood from FIG. 5A, the phase control pattern A controls phases at every waves in the control cycle. Similarly, the phase control pattern B controls phases at latter five waves in the first control cycle and every wave in the later control cycles. Moreover, the phase control pattern C controls phases at every waves in both the first and the later control cycles.

In exemplary embodiments, the phase control pattern A may be selected when the turn-off period of the heater 21 is shorter than 10 seconds. The phase control pattern B may be selected when the turn-off period of the heater 21 is longer than 10 seconds and shorter than 20 seconds. The phase control pattern C may be selected when the turn-off period of the heater 21 is longer than 20 seconds.

Referring again back to FIG. 2, the heater control circuit 30 converts an electrical voltage from the commercial power supply 40 into the appropriate voltage and generates the conducting pattern based on the driving signal applied from the transmitter 17. The conducting pattern is applied to the heater 21.

Figure 6:
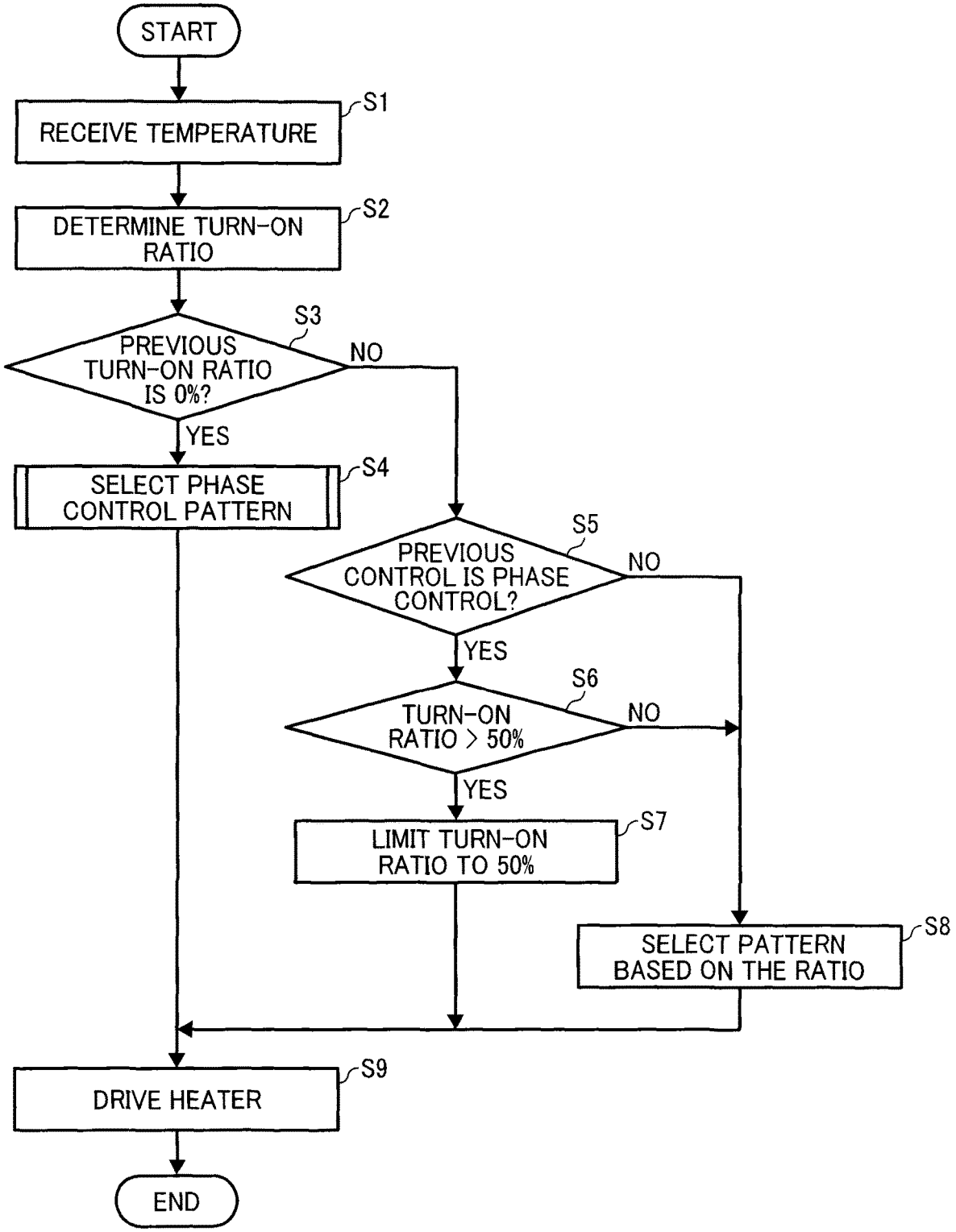
FIG. 6 illustrates a flowchart of an exemplary heater control method.

Hereinafter, an example of control process for controlling the heater 21 will be explained. FIG. 6 is a flowchart illustrating the control method of the embodiment.

First, at step S1, the temperature detector 11 receives the surface temperature of the heating object 25 from the temperature sensor 22. Next, at step S2, the determination circuit 12 receives the detected surface temperature of the heating object 25 from the temperature detector 11. In addition, the determination circuit 12 determines the turn-on ratio of the heater 21 for every control cycle of AC voltage, in accordance to the difference between the surface temperature and the target temperature of the heating object 25.

Then, at step S3, the duty limiter 13 determines whether the turn-on ratio of previous control cycle is 0%. If the previous turn-on ratio is 0%, the control process proceeds to step S4. At step S4, the duty limiter 13 generates a command to start turn on of the heater 21 with the phase control method. Further, the selector 16 selects appropriate phase control pattern among the plurality of phase control patterns stored in the memory 14. Then, the control process proceeds to step S9. Here, how to select the phase control pattern at step S4 will be explained in detail later in FIG. 7.

At step S3, if the previous turn-on ratio is not 0%, the control process proceeds to step S5. At step S5, the duty limiter 13 determines which one of the phase control or the half-wave control was performed during previous control cycle.

When the control method of previous control cycle was not phase control, the control process proceeds to step S8. At step S8, the duty limiter 13 provides the previous turn-on ratio to the selector 16. Then, the selector 16 selects appropriate half-wave control pattern among the plurality of half-wave control patterns stored in the memory 14, based on the previous turn-on ratio.

On the contrary, at step S5, when the control method of previous control cycle was phase control, the control process proceeds to step S6. At step S6, the duty limiter 13 determines whether the turn-on ratio determined at the determination circuit is more than 50%. At S7, when the turn-on ratio is more than 50%, the duty limiter 13 limits the turn-on ratio to 50%. The selector 16 selects half-wave control pattern with the turn-on ratio of 50%, as illustrated in FIG. 3A. On the contrary, when the duty ratio is lower than 50%, the duty limiter 13 provides the previous turn-on ratio to the selector 16. Then, at step S8, the selector 16 selects appropriate half-wave control pattern among the plurality of half-wave control patterns stored in the memory 14, based on the previous turn-on ratio.

At step S9, the selected phase control pattern or half-wave control pattern is applied to the transmitter 17. The transmitter 17 generates a driving signal to drive turn-on and turn-off of the heater 21, and applies the driving signal to the heater control circuit 30.

Figure 7:
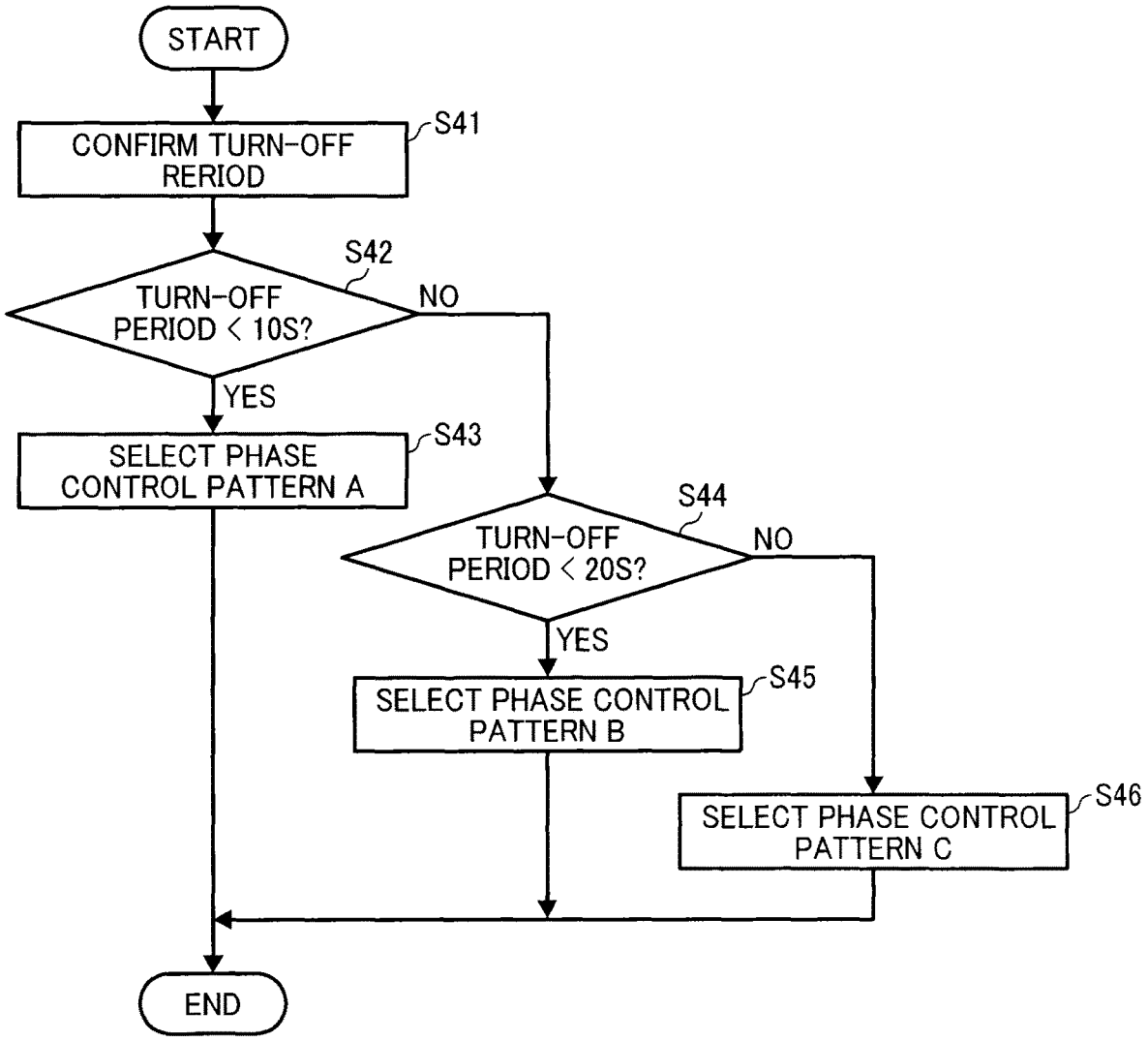
FIG. 7 illustrates a flowchart of an exemplary heater phase control pattern selection method.

Next, how to select the phase control pattern at step S4 will be explained in detail in FIG. 7. FIG. 7 is a flowchart illustrating the phase control pattern selection of this embodiment.

First, at step S41, the selector 16 confirms turn-off period of the heater 21. For example, the turn-off period can be confirmed by reading operation log of the print engine 1. The operation log can be recorded using ordinary technique. The operation log is not essential to the embodiment, so the detailed explanation is omitted. Otherwise, the turn-off period can be calculated by simply counting the turn-off time.

Next, at step S42, the selector 16 determines whether the turn-off period is shorter than 10 seconds. If the turn-off period is shorter than 10 seconds, control process proceeds to step S43. At step S43, the selector 16 selects the phase control pattern A from memory 14, as illustrated in FIG. 5A.

At step S42, if the turn-off period is longer than 10 seconds, then the control process proceeds to step S44. At step S44, the selector 16 determines whether the turn-off period is shorter than 20 seconds. If the turn-off period is shorter than 20 seconds, control process proceeds to step S45. At step S45, the selector 16 selects the phase control pattern B (in FIG. 5A) from the memory 14.

At step S44, if the turn-off period is longer than 20 seconds, then the control process proceeds to step S46. At step S46, the selector 16 selects the phase control pattern C (in FIG. 5A) from the memory 14.

As explained above, the duty limiter 13 limits the turn-on ratio to 50% when the phase control is performed during previous control cycle. Moreover, the processor 15 selects appropriate half-wave control pattern from the memory 14. Thus, the heater 21 is controlled. As a result, there are no consecutive turn-on patterns during the half-wave control cycle after the phase controlled cycle, thereby providing a reduction in flicker.

Another exemplary control method will now be explained. In particular, an exemplary control method may be performed by a print engine with the same configuration as the print engine illustrated in FIG. 1. The detailed configuration of a print engine of the second embodiment will be omitted. In such a print engine, the duty limiter 13 further performs the duty.

Figure 8:
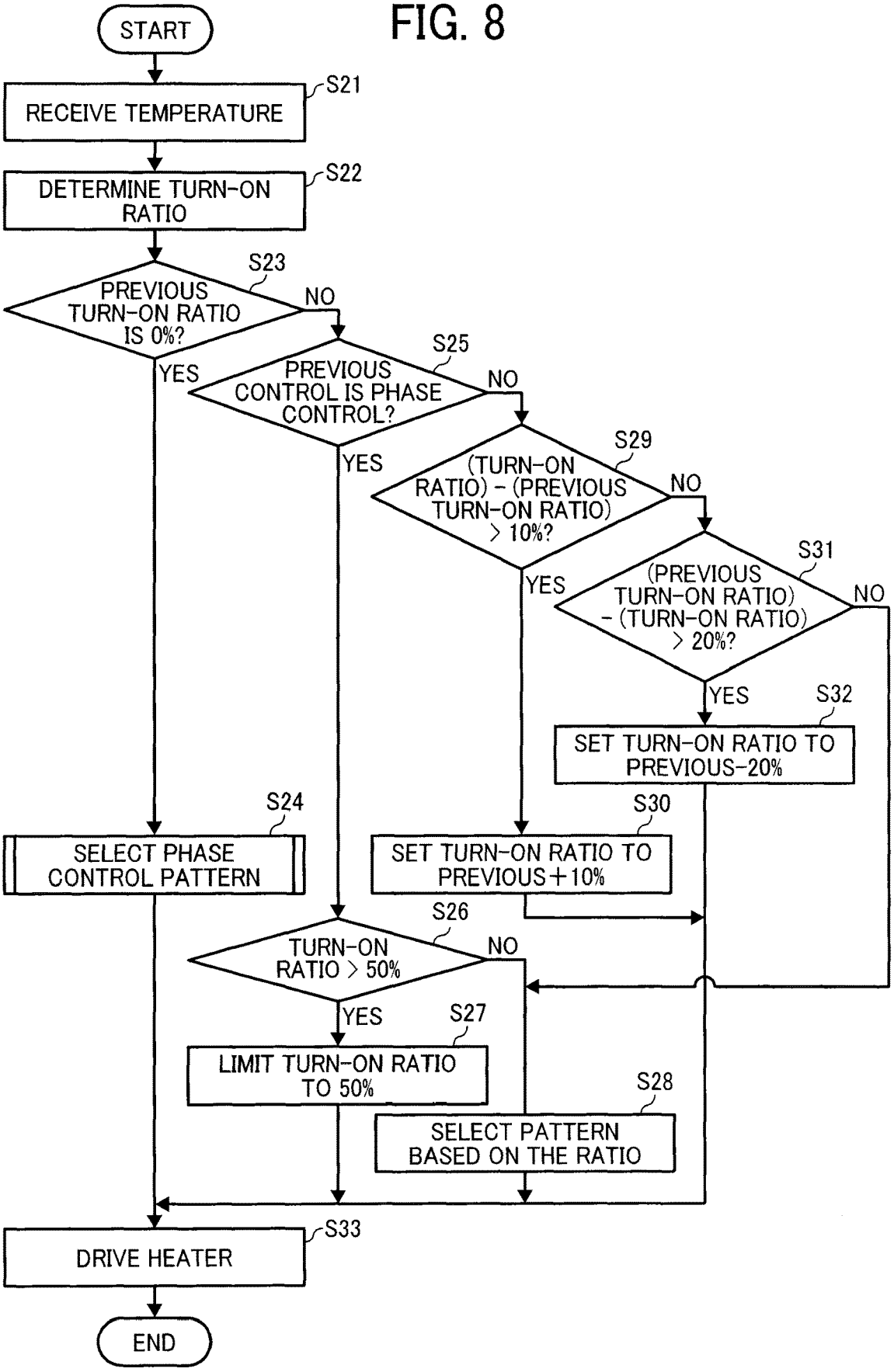
FIG. 8 illustrates a flowchart of another exemplary heater control method.

FIG. 8 is a flowchart illustrating the control method of the second embodiment. In FIG. 8, steps S21 to S24 are similar to the steps S1 to S4 in FIG. 6. Namely, at step S21, the temperature detector 11 receives the surface temperature of the heating object 25 from the temperature sensor 22. Next, at step S22, the determination circuit 12 receives the detected surface temperature of the heating object 25 from the temperature detector 11. In addition, the determination circuit 12 determines the turn-on ratio of the heater 21 for every control cycle of AC voltage, in accordance to the difference between the surface temperature and the target temperature of the heating object 25.

Then, at step S23, the duty limiter 13 determines whether the turn-on ratio of previous control cycle is 0%. If the previous turn-on ratio is 0%, the control process proceeds to step S24. At step S24, the duty limiter 13 generates a command to start turn on the heater 21 with the phase control method. Further, the selector 16 selects appropriate phase control pattern among the plurality of phase control patterns stored in the memory 14. Then, the control process proceeds to step S33.

At step S23, if the previous turn-on ratio is not 0%, the control process proceeds to step S25. At step S25, the duty limiter 13 determines which one of the phase control or the half-wave control was performed during previous control cycle. When the control method of previous control cycle was phase control, the control process proceeds to step S26. At step S26, the duty limiter 13 determines whether the turn-on ratio determined at the determination circuit is more than 50%. When the turn-on ratio is more than 50%, the duty limiter 13 limits the turn-on ratio to 50%. Then, at step S27, the selector 16 selects half-wave control pattern with the turn-on ratio of 50% (FIG. 3A). On the contrary, when the duty ratio is lower than 50%, the duty limiter 13 provides the previous turn-on ratio to the selector 16. Then, at step S28, the selector 16 selects appropriate half-wave control pattern among the plurality of half-wave control patterns stored in the memory 14, based on the previous turn-on ratio.

On the contrary, at step S25, when the control method of previous control cycle was not phase control, the control process proceeds to step S29. At step S29, the duty limiter 13 compares the (a) turn-on ratio determined at step S22 and (b) the turn-on ratio of the previous control cycle. Then, the duty limiter 13 determines whether a result of (a)−(b) is more than 10%. If the result at step S29 is more than 10%, the control process proceeds to step S30. At step S30, the duty limiter 13 sets the turn-on ratio of current control cycle as the turn-on ratio of the previous control cycle+10%. Then, the selector 16 selects appropriate half-wave control pattern among the plurality of half-wave control patterns stored in the memory 14, based on the turn-on ratio set by the duty limiter 13.

Figure 9A:
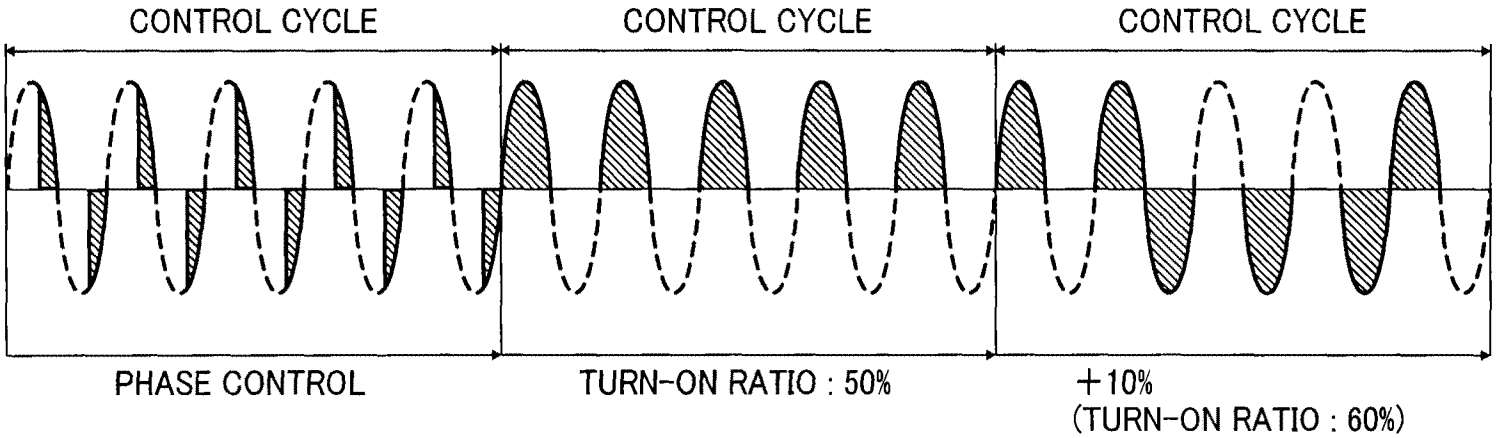
FIG. 9A illustrates another exemplary phase control pattern.

FIG. 9A illustrates the result of such control by step S29. In FIG. 29, three control cycles are shown. The phase control is performed during the first control cycle, and the half-wave control is performed during the second and the third control cycles. During the second control cycle, the turn-on ratio is set to 50% and during the third control cycle, the turn-on ratio increases 10% and is set to 60%. By applying such control, sudden increase of the turn-on ratio can be avoided and the flicker can be suppressed. Here, increasing step of the turn-on ratio is not limited to 10%, but it can be arbitrarily value.

Referring back to FIG. 8, if the result at step S29 is not more than 10%, the control process proceeds to step S31. At step S31, the duty limiter 13 compares (b) the turn-on ratio of the previous control cycle and (a) turn-on ratio determined at step S22. Then, the duty limiter 13 determines whether a result of (b)−(a) is more than 20%.

If the result at step S31 is more than 20%, the control process proceeds to step S32. At step S32, the duty limiter 13 sets the turn-on ratio of current control cycle as the turn-on ratio of the previous control cycle—20%. Then, the selector 16 selects appropriate half-wave control pattern among the plurality of half-wave control patterns stored in the memory 14, based on the turn-on ratio set by the duty limiter 13.

Figure 9B:
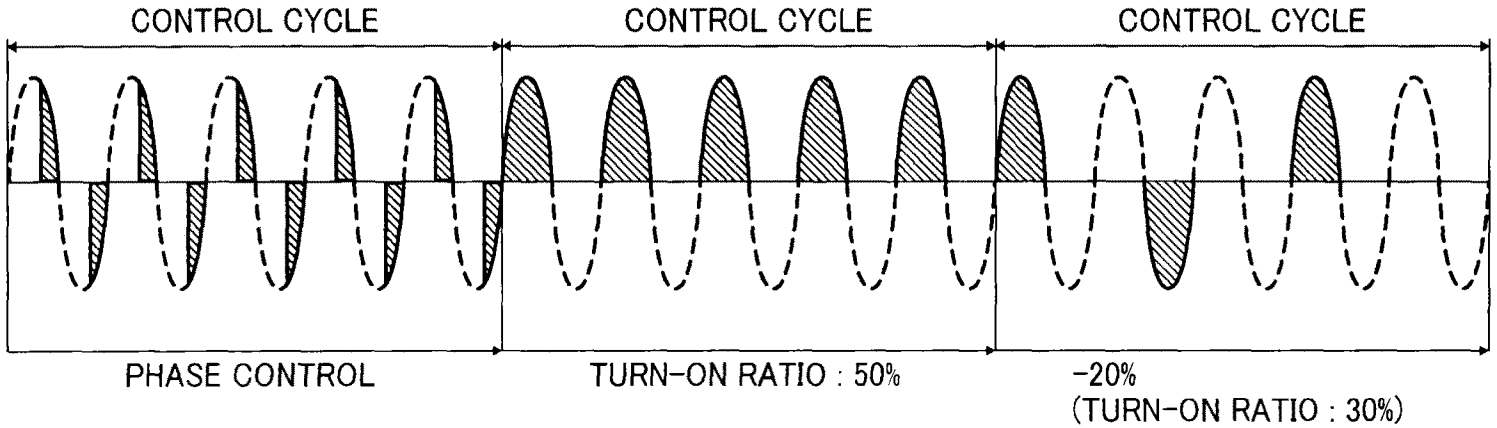
FIG. 9B illustrates additional exemplary phase control patterns.

FIG. 9B illustrates the result of such control by step S31. In FIG. 32, three control cycles are shown. The phase control is performed during the first control cycle, and the half-wave control is performed during the second and the third control cycles. During the second control cycle, the turn-on ratio is set to 50% and during the third control cycle, the turn-on ratio decreases 20% and is set to 30%. By applying such control, sudden decrease of the turn-on ratio can be avoided and the flicker can be suppressed.

Again, referring back to FIG. 8, if the result at step S32 is not more than 20%, the control process proceeds to step S28. At step S28, the selector 16 selects appropriate half-wave control pattern among the plurality of half-wave control patterns stored in the memory 14, based on the turn-on ratio.

At step S33, the selected phase control pattern or half-wave control pattern is applied to the transmitter 17. The transmitter 17 generates a driving signal to drive turn-on and turn-off of the heater 21, and applies the driving signal to the heater control circuit 30.

As explained above, the duty limiter 13 limits the turn-on ratio during the control cycle two cycles after the control cycle with the phase control method. Here, the limiting function is performed by comparing the (a) turn-on ratio determined at step S22 and (b) the turn-on ratio of the previous control cycle. Thus, the heater 21 is controlled. As a result, sudden variation of the turn-on ratio can be avoided and this reduces the flicker.

Figure 10:
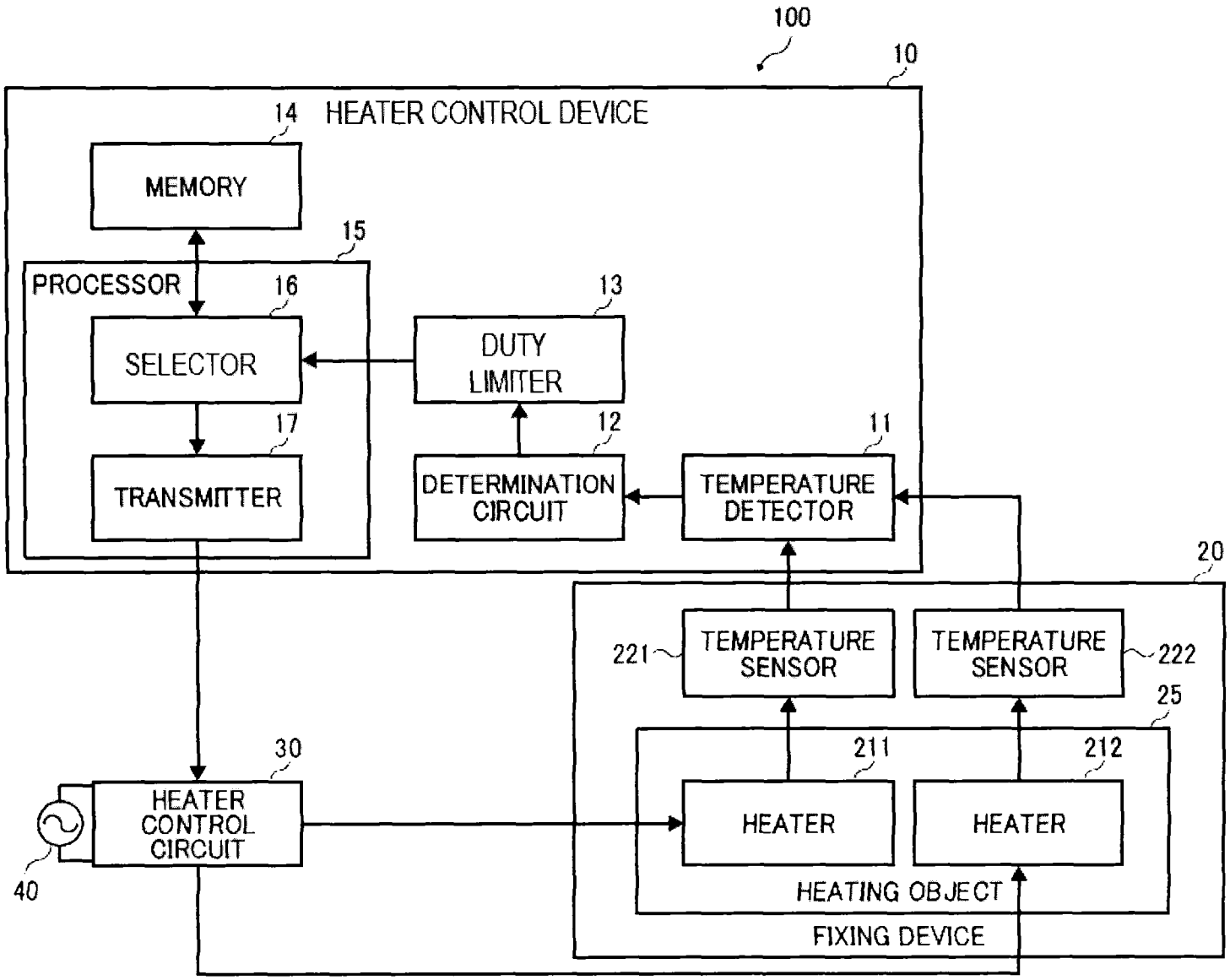
FIG. 10 illustrates a block diagram of a heater controller.

Yet another exemplary print engine including first and second heaters will now be explained. FIG. 10 illustrates a block diagram illustrating the heater controller 100 of the third embodiment. The heater controller 100 of the third embodiment includes a heater control device 10, a fixing device 20, and a heater control circuit 30. The fixing device 20 includes a heater 211, a heater 212 a temperature sensor 221, and a temperature sensor 222. The fixing device 20 further includes a heating object 25.

The temperature sensor 221 is disposed in close proximity of the heater 211 and detects the surface temperature of a heating object 25. Similarly, the temperature sensor 222 is disposed in close proximity of the heater 212 and detects the surface temperature of the heating object 25.

Figure 11:
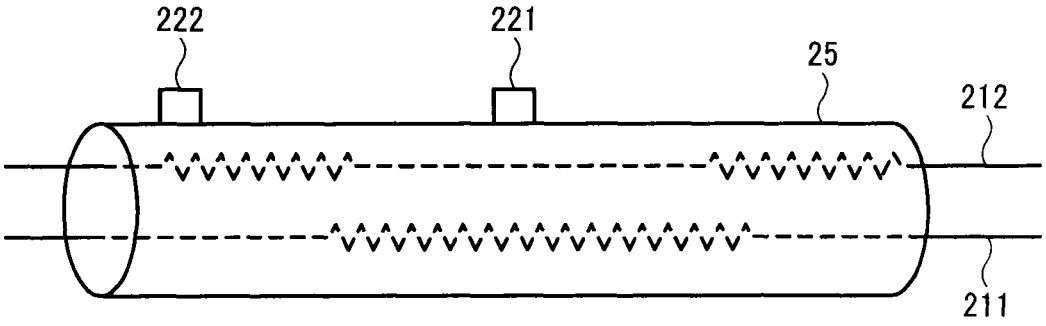
FIG. 11 illustrates an exemplary heating object.

Here, positional relationship of the temperature sensors, heaters and heating object 25 will be explained. FIG. 11 illustrates an example of the heating object 25. In FIG. 11, the heating object 25 is illustrated as a heating roller 25. The heating roller 25 has a cylindrical shape, and inside the heating roller 25, the heater 211 and the heater 212 are located. The heater 211 acts as a main heater, and it heats center portion of the heating roller 25. On the contrary, the heater 212 acts as a sub heater and it heats both sides of the heating roller 25. Accordingly, the heater 211 has a heating element at the center portion, and the heater 212 has two heating elements at the both side. Therefore, the heater 211 detects the temperature of the heating roller 25 at the center portion, and the heater 212 detects the temperature of the heating roller 25 at the side portions. Such heating object 25 is the same to the configuration in FIG. 1 except a number of the heater.

Referring back to FIG. 10, outputs of the temperature sensor 221 and the temperature sensor 222 are applied to the temperature detector 11. The temperature detector 11 detects the surface temperature of the heating object 25, by receiving the output values of the temperature sensors 221 and 222. The detected surface temperature of the heating object 25 is applied to the determination circuit 12.

The function of the determination circuit 12, the duty limiter 13, and the memory 14 are substantially the same to the first and the second embodiments. However, since this embodiment has two heaters 211 and 212, the control process of FIG. 6 is performed for the heater 211 and the heater 212 individually.

The memory 14 stores a plurality of phase control patterns associated with turn-off periods of the heater 211 and the heater 212.

Furthermore, the function of the processor 15, the selector 16, and the transmitter 17 are also substantially similar to the first and the second embodiments.

Figure 12A:
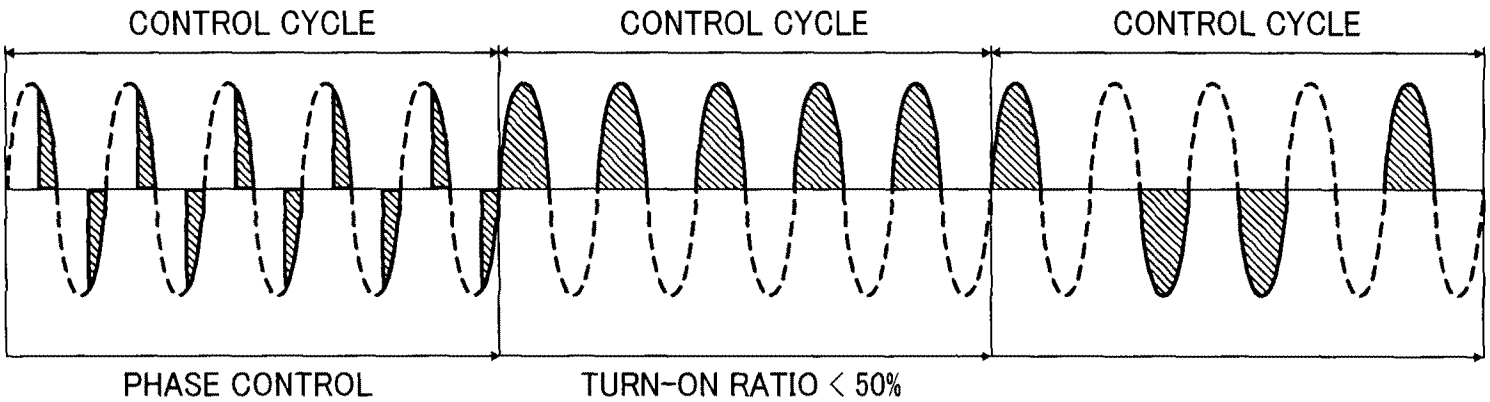
FIG. 12A illustrates another heater control method.
Figure 12B:
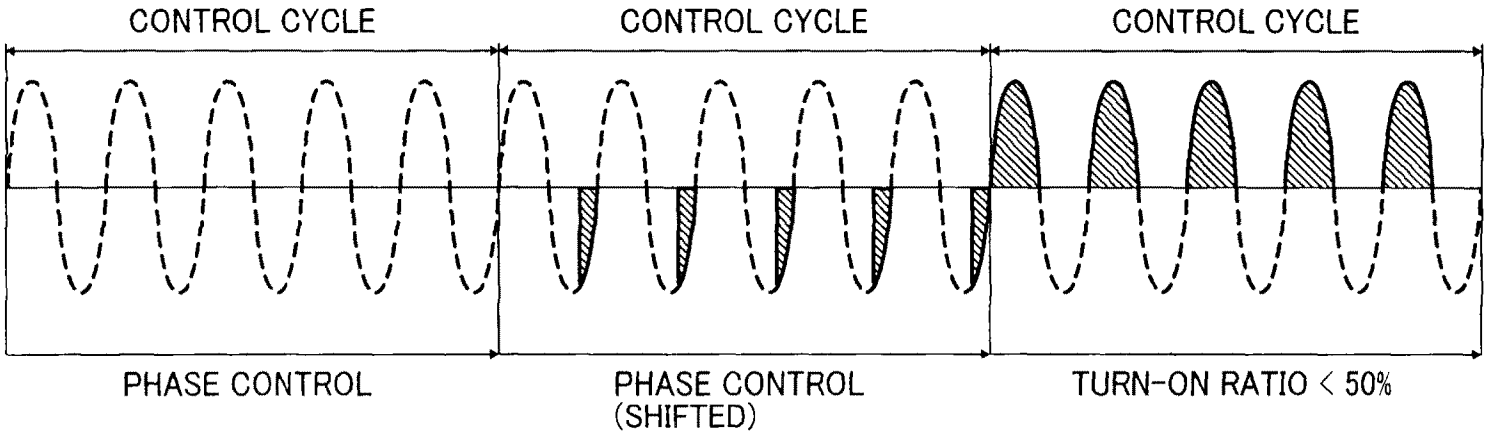
FIG. 12B illustrates a heater control method utilizing a second heater.

FIG. 12A and FIG. 12B illustrate an example of control method of third embodiment. Here, FIG. 12A illustrates a control method for the heater 211 and FIG. 12B illustrates a control method for the heater 211.

The processor 15 of this embodiment adjusts the start timing of the heater 212. More specifically, the transmitter 17 shifts the transmission timing by one control cycle to send the driving signal to the heater 212. Moreover, the selector 16 selects appropriate phase control pattern when driving the heater 212. In other words, in the phase control pattern for the heater 212, turn-on is allocated to the turned-off half-waves for the heater 211.

FIG. 12A illustrates three consecutive control cycles. Considering to the second control cycle, the turn-on ratio of the previous control cycle, namely the first control cycle is not 0% because the control method of the first control cycle is the phase control. Accordingly, the determination at step S3 is "No" and the control process proceeds to step S5. Then, because the previous control method, namely the control method of the first control cycle is the phase control, the determination at step S5 is "Yes" and the control process proceeds to step S6.

Similarly, considering to the third control cycle, the turn-on ratio of the previous control cycle, namely the second control cycle is not 0% and the control method of the previous control cycle is the half-wave control. Accordingly, the control process proceeds step S3 "No", step S5 "No" and step S8. As a result, in FIG. 12A, the phase control is performed during the first control cycle, and the half-wave control is performed during the second and the third control cycles.

FIG. 12B also illustrates three consecutive control cycles. Among the three control cycles, the phase control is performed during the first and the control cycles, and the half-wave control is performed during the third control cycles. The transmitter 17 shifts the start timing for controlling the heater 212 to the second control cycle. Moreover, in the second control cycle, the phase control pattern for the heater 212 is selected so as not to the turn-on period of the heater 211 and the heater 212 duplicates.

Here, the number of the heater is not limited to two, but is may be an arbitrary number. In other words, the number of the heaters may be more than three. In such case, the transmitter 17 shifts the start timing for every heater by one control cycles. In addition, in the phase control pattern for each heater, turn-on is allocated to the turned-off half-waves for the other heaters.

As explained above, the transmitter 17 shifts the start timing. Moreover, the selector 16 selects appropriate phase control pattern when driving the heater. This reduces the flicker in case that is caused by the multiple heaters.

Here, at least one of the function of the temperature detector 11, determination circuit 12, the duty limiter 13 and the processor 15 can be realized by software, which is executed by, for example, a microprocessor. In addition such software can be provided as a computer program product, which is stored in the storage medium, for example but not limited to, CD-ROM, CD-R, DVD (Digital Versatile Disk) or memory cards as an installable or executable format file. Further, such software can be distributed through the network, such as Internet. Still further, such software can be provided by storing in ROM.

Such software has a module-type structure which includes each functional block, namely, the functions for the temperature detector 11, determination circuit 12, the duty limiter 13 and the processor 15. These functional blocks are read out from the storage medium and loaded in a main memory for the microprocessor. In other words, these functional blocks are realized by the microprocessor and the main memory, etc.

What is claimed is:

1. A heater controller for a heater, the heater controller comprising:

a detector that detects a temperature of a heating object, the heating object is heated by the heater;

a determination circuit that determines, based on a surface temperature of the heating object and a target temperature of the heating object, a turn-on ratio of the heater for every control cycle of an AC voltage;

a memory that stores a plurality of turn-on control patterns;

circuitry configure to determine whether a control method of a previous control cycle is phase control;

a limiting circuit that limits the turn-on ratio of a current control cycle when the control method of the previous control cycle is phase control;

a selection circuit that selects a control pattern to control the heater, based on the turn-on ratio limited by the limiting circuit; and a driving circuit that outputs a heater driving signal to the heater according to the control pattern selected by the selection circuit.

2. The heater controller according to claim 1, wherein the driving circuit allocates a turn-off to a last half-wave in the control cycle with half-wave control.

3. The heater controller according to claim 1, wherein the driving circuit, when the limiting circuit limits the turn-on ratio, allocates a turn-off to a half-wave that results from the turned-on half-wave.

4. The heater controller according to claim 1, wherein the limiting circuit limits the turn-on ratio of the current control cycle based on the turn-on ratio of the previous control cycle and the current turn-on ratio determined by the determination circuit when the phase control is performed for the control cycle proceeding the previous control cycle.

5. The heater controller according to claim 1, wherein the heater includes a plurality of heaters, and the driving circuit shifts the control cycle to start each heater of the plurality of heaters.

6. The heater controller according to claim 5, wherein the driving circuit allocates a turned-on half-wave of the phase control for one of the heaters to turned-off half-wave for another one of the heater.

7. The heater controller according to claim 1, wherein when the control method of the previous control cycle is not phase control, the limiting circuit provides a previous turn-on ratio to the selection circuit which selects a half-wave control pattern.

8. A heater controller for a heater, the heater controller comprising:

a detector that detects a temperature of a heating object, the heating object is heated by the heater;

a memory that stores a plurality of turn-on control patterns; and circuitry configured to:

determine, based on a surface temperature of the heating object and a target temperature of the heating object, a turn-on ratio of the heater for every control cycle of an AC voltage;

determine whether a control method of a previous control is phase control;

limit the turn-on ratio of a current control cycle when the control method of the previous control cycle is phase control;

select a control pattern to control the heater, based on the turn-on ratio limited by the limit the turn ratio; and output a heater driving signal to the heater according to the control pattern selected by the select the control pattern.

9. The heater controller according to claim 8, wherein the circuitry is further configured to allocate a turn-off to a last half-wave in the control cycle with half-wave control.

10. The heater controller according to claim 8, wherein the circuitry, when the turn-on ratio is limited, allocates a turn-off to a half-wave that results from the turned-on half-wave.

11. The heater controller according to claim 8, wherein the circuitry limits the turn-on ratio of the current control cycle based on the turn-on ratio of the previous control cycle and the current turn-on ratio determined by the determine the turn-on ratio when the phase control is performed for the control cycle proceeding the previous control cycle.

12. The heater controller according to claim 8, wherein the heater includes a plurality of heaters, and the circuitry shifts the control cycle to start each heater of the plurality of heaters.

13. The heater controller according to claim 12, wherein the circuitry allocates a turned-on half-wave of the phase control for one of the heaters to turned-off half-wave for another one of the heater.

14. The heater controller according to claim 1, wherein when the control method of the previous control cycle is not phase control, a half-wave control pattern is selected based on a previous turn-on ratio.

* * * * *